United States Patent [19]

Kubach et al.

[11] Patent Number: 4,722,364

[45] Date of Patent: Feb. 2, 1988

[54] ELECTROMAGNET FOR FUEL INJECTION SYSTEMS

[75] Inventors: Hans Kubach, Korntal-Münchingen; Asta Hascher-Reichl, Stuttgart, both of Fed. Rep. of Germany

[73] Assignee: Robert Bosch GmbH, Stuttgart, Fed. Rep. of Germany

[21] Appl. No.: 10,069

[22] Filed: Feb. 2, 1987

[30] Foreign Application Priority Data

Feb. 13, 1986 [DE] Fed. Rep. of Germany ..... 3604436

[51] Int. Cl.[4] ..... F15B 13/044

[52] U.S. Cl. ..... 137/625.65; 251/129.08; 251/129.16

[58] Field of Search ..... 137/625.65; 251/129.16, 251/129.08

[56] References Cited

U.S. PATENT DOCUMENTS 1,652,329 12/1927 Saives .
1,664,613 4/1928 French .
4,655,254 4/1987 Hafner ..... 137/625.65

FOREIGN PATENT DOCUMENTS 3402117 7/1985 Fed. Rep. of Germany ..... 251/129.16

OTHER PUBLICATIONS

SAE-Paper No. 850170, "High-Pressure Injection Pumps with Electronic Control for Heavy-Duty Diesel Engines" by R. Schwartz, Robert Bosch GmbH, pp. 11 and 12, FIG. 19, Feb. 25-Mar. 1, 1985.

*Primary Examiner*—Gerald A. Michalsky
*Attorney, Agent, or Firm*—Edwin E. Greigg

[57] ABSTRACT

A 3/3 way control valve including a three-stage electromagnet for controlling a hydraulic working cylinder that actuates a control member of an injection system, including a winding of the electromagnet the axis of which extends crosswise to the axis of an armature and directional control valve and in which the pole pieces of the pole legs of the yoke are unequally polarized. The armature is actuated counter to a restoring spring and slides between two corresponding cylindrical hollow faces of the pole pieces which act as a proportional magnet, and in which the winding and in part the yoke have an extrusion coat of insulating plastic.

17 Claims, 3 Drawing Figures

ELECTROMAGNET FOR FUEL INJECTION SYSTEMS

BACKGROUND OF THE INVENTION

The invention is based on a three-stage electromagnet of a 3/3-way magnetic valve for fuel injection systems. An electromagnet of this type actuates the directional control valve slide counter to the force of the restoring spring; in its non-magnetized position, it connects the working cylinder, which for instance actuates the injection quantity control member, with a return line, while in a middle position of the armature or slide it blocks a connection with the work cylinder, and in the end position of the armature or slide, that is, when it is supplied with maximum current, it conconnects a hydraulic source with the work cylinder, which then acts in the direction of increasing injection quantity. The problem here is the triggering of the middle position, because this position is not determined by any stop for the armature or slide but instead is a function of a mean value of the electric current supplied to the magnet. To this end, the magnetic forces corresponding to the mean value range of the electric current must be unequivocally distinguished from the limiting forces, that is, zero force and maximum force, corresponding to the limit currents of zero and maximum current. In the ideal case, the hydraulic flow should correspond to the electric current but with the middle position as zero; that is, a maximum electric current would mean maximum hydraulic current in the direction of increasing injection quantity, and minimum electric current (zero current) should correspond to maximum hydraulic flow in the direction of decreasing injection quantity.

In controlling slide valves it is typical to use magnets in which the core housing has a central core about which the winding is disposed coaxially with the direction of movement of the slide, so that the magnetic flux flows via this central core and the outer parts of the housing as well as the armature. Two principles of application are known for the manner in which the force flows. By one of these principles, the armature is provided with a central bore and is disposed so that it slides on the core, and when magnetically excited it plunges into an opening provided therefor between the outer yoke parts. The armature has an internal cone on the side facing the yoke, so that if the restoring spring has a linear characteristic, an adjustment of the armature or variation of the magnetic force that is proportional to the current intensity is attainable. Such proportional magnets, which can be adjusted as a function of a characteristic curve, have the disadvantage that of the two air gaps (between the core and armature and between the core and housing), only one—for instance, between the core and the housing—contributes to a generating force; the other air gap requires nonuseful magnetic energy. Since the magnetic pole having a first polarity (for instance positive) is supported between the poles of a second polarity, the stray flux at a given outer diameter is relatively high. Because of asymmetry, friction losses also occur between the armature and the core, besides the fact that such a magnet is relatively vulnerable to dirt. A further disadvantage is that one or two ring seals for sealing the magnet from the outside must be provided, namely between the valve region and the winding, to prevent oil from getting into the cup of the magnet, which receives the winding and has openings on its end face remote from the valve through which the connection cable passes. Usually, another ring seal must also be provided between this magnet cup and the housing receiving the magnet.

The other application principle of magnets of this kind actuating control slides relates to flat pole magnets, in which the armature does not plunge radially inward as in the case of the proportional magnets. As a result, however, characteristic curve influence cannot be exerted and the characteristic curve of the stroke has a quadratic course instead; that is, the magnetic force decreases by a power of two with increasing distance. This disadvantage can be compensated for only by a complex and expensive nonlinear characteristic electrical curve on the valve side for controlling flow; however, the system remains asymmetrical and thus accuracy of control is much more difficult to achieve. Although the vulnerability to dirt is much less in comparison with the first application principle above, and the additional friction forces are sharply decreased as well, namely by eliminating the need to guide the armature centrally on the core, the disadvantage of having to provide twice as many seals remains.

OBJECT AND SUMMARY OF THE INVENTION

The electromagnet according to the invention has a great number of advantages over the prior art. The magnet according to the invention has the feature of having a linear characteristic curve—that is, it is a proportional magnet—in which lesser radial forces arise, so that wide bearing tolerance is allowed and the magnet is relatively invulnerable to dirt. In contrast to the above-described known magnet principles, the radial forces that may possibly arise are less, especially taking into consideration the fact that near the working gap the iron is usually saturated, and only with unsaturated iron are the radial forces approximately the same in comparable magnets.

A further advantage is that because a central core is omitted, the valve and magnet housing can be manufactured less expensively and can be machined to be circularly symmetrical by clamping it in position only once. Thus, repeated machining operations with adjustment and re-clamping each time are unnecessary. The expense for centering a core with respect to the axis of the valve as a whole is dispensed with. Because there are only two pole regions, embodied by the pole pieces, tolerance is less of a problem in the insertion of the armature into the yoke region in comparison with a circular pole region such as in the above-described known magnets. A cone on the armature or on the counterpart to the armature is not absolutely necessary for attaining a proportional function. With high magnetic flux density, saturation occurs in the air gap, so that the magnetic flux is stabilized in usch a way that eccentricities do not produce any great radial forces. Because the magnetic core is omitted, the proportion of stray flux is minimized as well.

There are also substantial advantages in terms of sealing. To seal off the hydraulic region from the connection region, only a single seal is needed, which is disposed between the insulating plastic and the housing, for instance a bore wall, that receives the magnetic valve.

Because of the lessening of stray inductance in the inventive device, electromagnet damping becomes more important. The low stray flux also has the advantage that the armature mass can lso be reduced, since conventionally the flux is axially distributed in the armature between the two radial flux courses in the air gaps.

In contrast to the above-described known application principles, in one embodiment of the invention the armature and valve slide may be in one piece, since the armature of the system according to the invention is located in a plane of symmetry of the magnetic field, so that the magnetomotive force there is zero. The advantage is that no undesirable diminution of force occurs the valve slide is made of magnetic material. Since field lines hardly emerge there, hardly any soil particles are magnetically attracted. Because the valve slide and magnetic armature are made in one piece of magnetically conductive material, the considerable production cost attributable to adjustment can also be reduced.

In one feature of the invention, the pole legs of the yoke are freely exposed to the outside, so that an increased heat dissipation occurs. This provides the opportunity of increasing the magnetic force, or improving the electric time constant, which can be particularly important in the cancellation of the current by a recovery diode.

According to a feature of the invention, the electromagnet system has a circular cross section on its end remote from the armature, at which it can be radially sealingly inserted into a corresponding bore of the housing, which may for example be the injection pump, and the connection cables are extended to the outside at the end remote from the hydraulic side. As a result, a single radial seal is sufficient to prevent the escape of the hydraulic fluid. The current connection cables are extended to the outside on the side remote from the fluid, from a self-contained plastic package that also receives the winding. This kind of sealing is possible only because the magnetic part is not bored through in the axial direction, as in the known application principles; instead, the winding fills up the entire interior. At this end, a mounting bracket can also advantageously be connected to the plastic, or a sheet-metal cup surrounding the plastic at this end and stabilizing it can be provided.

According to an additional feature of the invention, the yoke may comprise a laminated sheet-metal packet, the sheets of which are joined together for instance by gluing or welding, and in particular laser welding. As a result, formation of turbulent flows can largely be prevented.

In another feature of the invention, a stop plate of nonmagnetic material is provided in the adjustment direction facing the armature, and the restoring spring is supported on this plate, which is plastically deformable to compensate for the force of the restoring spring in the adjustment direction. This deformation may be effected in the fully assembled valve, by deforming the spring bearing on the stop plate slightly by pressing it backward via a pin through the central valve slide and armature bore serving to provide relief. Since the insulating material has only a limited temperature stability and long-term stability, the stop plate may have an axial deformation in the peripheral region, by means of which it can be fastened resiliently in a form fitting manner between the pole pieces and the winding part.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
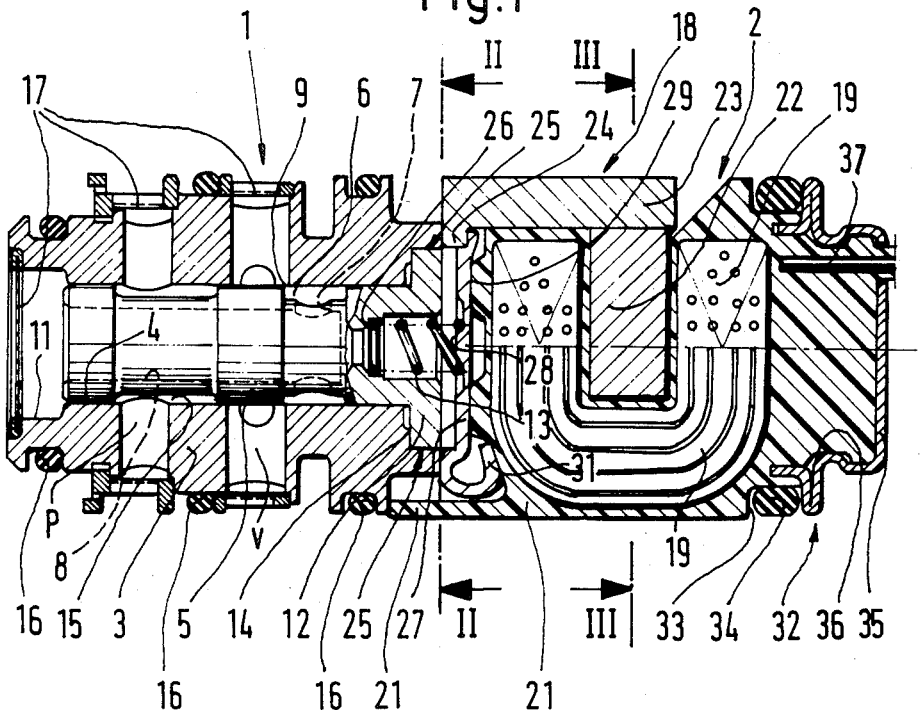
FIG. 1 is a longitudinal section through a magnetic valve having a partial sectional offset, taken along the lines I—I of FIGS. 2 and 3.
Figure 2:
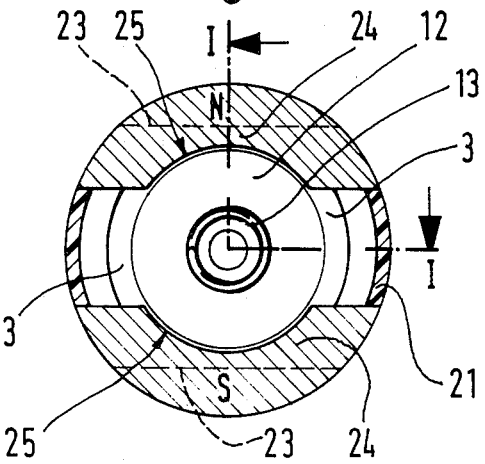
FIG. 2 is a cross section taken along the lines II—II of FIG. 1, without a sectional offset.
Figure 3:
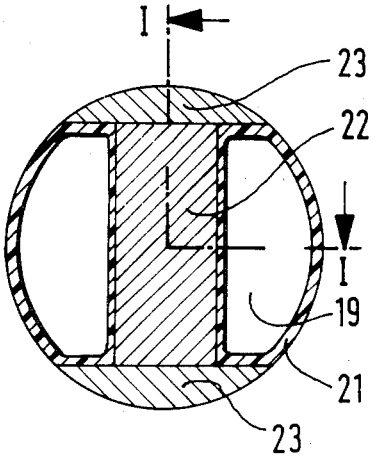
FIG. 3 is a cross section taken along the line III, III of FIG. 1, again without a sectional offset.

The 3/3-way magnetic valve shown in FIGS. 1-3 has been especially developed for fuel injection systems, but it can equally well be applied to other useful tasks. This magnetic valve comprises a directional control valve 1 and a magnet 2, which are assembled and inserted as a unit into a housing, for instance such as a bore of an injection system housing, because the directional control valve 1 and the magnet 2 have the same diameter. In the manner of a conventional directional control valve, a control slide 5 is disposed such that it is axially movable in a central bore 4 of a valve body 3. In the initial position of the control slide shown, the consumer connection V is connected via an annular groove 6 and radial bores 7 in the control slide 5 with a central relief bore 8 shown by dotted lines, so that the control fluid can flow away from the consumer without being under pressure. A hydraulic working cylinder is provided as the consumer V, by way of which the quantity control member of the injection pump is actuated, so that when the working cylinder is relieved, that is, in the position shown of the control slide 5, the quantity control member is adjusted in the direction of a decreasing injection quantity. The speed of adjustment depends on the restoring spring 13 engaging the working cylinder, and hence on the restoring pressure of the control fluid, on the one hand, and on the control cross section 9 between the connection V and the annular groove 6, on the other. The relief bore 8 discharges into the end section 11 of the central bore 4, which is pressure-relieved with respect to the fluid container via a screen 17.

As will be described below, the elctromagnet is embodied as a proportional magnet, so that in the range of planned current intensities, the control position of an armature 12 corresponds to the current intensity at that time. This armature 12 is integral with the control slide 5 and is urged by the restoring spring 13 in the direction of the initial position, or counter to the magnetic force. The armature 12 also has a larger diameter than the control slide 5, and the shoulder 14 formed by the difference in diameter rests on the valve body 3 which prevents movement to the left as shown in FIG. 1 to determine this initial position, which is the first characteristic control position.

To cause the control slide 5 to assume its second characteristic control position, the electromagnet is supplied with a predetermined mean value current intensity. This mean value of the electric current then corresponds to position of the control slide 5 in which the annular groove 6 is thus separated from the connection V—that is the control cross section 9 to the return line is closed. Then the working cylinder remains in whatever position it has assumed, because hydraulic fluid flows neither into nor out of it.

The third characteristic control position is assumed by the control slide 5 whenever the electromagnet 2 is supplied with full current intensity and the armature 12 along with the control slide 5 is displaced into its end position. In this end position, an annular groove 15 of the control slide 5, which is in continuous communication with a fluid inlet connection P leading to a pump, is made to communicate with the connection V, so that the control fluid can flow from the connection P to the connection V via the annular groove 15. Because a fluid supply under pressure is involved here, the plunger in the working cylinder is displaced accordingly, this displacement direction corresponding to an increase in the injection quantity. Depending on the current intensity, the control slide 5 can naturally also be displaced into other intermediate positions, so that a different control cross section is available for both the inflow and the outflow depending on the position; this is expressed in a specific control speed, or in other words duration of the variation in the injection quantity.

The connections V and P mentioned above face corresponding bores in the housing, not shown, which receives the valve body 3; in a known manner, toroidal sealing rings are provided to partition off these spaces on the valve body and effect sealing between this valve housing 3 and the bore that receives it. To prevent soiling in the control region filter screens 17 are also provided.

As the core housing, the electromagnet 2 has a yoke 18 and a winding 19, with an extrusion coat 21 of insulating material encompassing the winding.

Thus, like the axis of the winding 19, the middle section 22 of the yoke 18 that passes through the winding 19 extends crosswise to the longitudinal axis of the directional control valve 1. Two pole legs 23 are welded onto this middle section 22, terminating in pole pieces 24. These pole pieces 24 are axially offset, in the initial position, from two regions of a cylindrical jacket face 25 of the armature 12, while in the working position they are immediately opposite the jacket face. Upon excitation of the winding 19, a polarization takes place at the pole pieces 24 because of the winding and yoke arrangement; that is, they become north and south poles, as indicated by the letters N and S.

Since in FIG. 1 the electromagnet 2 has been sectioned in two different planes, 90° apart from one another, the pole leg 23 having the pole piece 24, in this case marked as the north pole, is shown only in the upper section. In fact, of course, this illustrated section has a symmetrical section facing it, as may also be understood from FIG. 2. Because the pole legs 23 have a relatively large outer jacket face, which also is located directly opposite the wall receiving the valve and may possibly even touch it slightly, and because of the relatively large circular-segmental cross section of the pole legs 23, very good heat dissipation occurs, so that a magnet of this kind can be subjected to relatively high loads.

The restoring spring 13 is supported on a shoulder 26 of the control slide 5, which is produced by an inner collar in the relief bore 8. On its end remote from this shoulder 26, the restoring spring 13 is supported on a stop flap 27, which is fastened in its edge region between the pole pieces 24 and the injected winding 19 and coating 21. To obtain an adjustment of the force of the restoring spring 13 that adapts to the magnetic force, the stop plate 27 can be slightly deformed in its middle region 28 via a pin guided through the relief bore 8, when the valve is already in its installed state; to this end, a corresponding elevated portion 29 of the plastic extrusion coat 21 serves as the spring support. The stop plate 27 also has spring brackets 31, so that even if the plastic has poor long-term stability the position of the middle region 28 of the stop plate 27 is maintained even after plastic deformation because of the elastic action of the spring bracket 31 and the metal contact of the stop plate 27 with the pole piece 24.

The insulating plastic extrusion coating 2 is embodied as circular in the section 32 remote from the directional control valve 1 and is provided with an annular groove 33 for receiving a toroidal sealing ring 34. The connection cables 37 are extended to the outside at the face end through the section 32, so that via the toroidal sealing ring 34 the otherwise complete extrusion-coating 21 is hydraulically isolated from the directional control valve 1. The extrusion coating 21 is also extended outside the pole pieces 24 as far as the valve body 3.

To enable removal of the electromagnet 2 from the housing, a mounting bracket 35 is disposed on the section 32 such that it is accessible from outside. This mounting bracket engages beads 36 of the plastic coating 21 and also serves at least partly as a reinforcing support for the toroidal sealing ring 34.

All the characteristics apparent from the description, the following claims and the drawing may be essential to the invention either individually or in any combination with one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A 3/3 way control valve having a three-stage electromagnet for controlling a hydraulic working cylinder which comprises a valve body, a control slide valve member in said valve body, said electromagnet including a yoke, a coil winding disposed on said yoke, an armature forming a magnetic circuit with said yoke, said armature being connected with one end of said slide valve member, a restoring spring, said armature being urged by said restoring spring counter to a magnetic force produced by said electromagnet when an electrical current is applied to said electromagnet, said armature assuming an initial position when said armature is without current, a middle position at a mean value of the applied electric current, and an end position at maximum applied current, said yoke including oppositely disposed pole legs (23) each of which include oppositely disposed pole pieces (24), said armature (12) having a cylindrical cross section and sliding between said pole pieces (24) of the yoke (18), the pole pieces (24) of the pole legs (23) of the yoke (18) being unequally polarized (north/south), said coil winding having an axis that extends crosswise to the axis of movement of the armature (12) and valve body (3) of the control valve (1), and said coil winding (19) of the electromagnet is provided with an extrusion coating (21) of an insulating plastic.

2. A 3/3 way control valve as defined by claim 1, in which, said control slide valve member (5) and said armature (12) are of one piece and formed of the same material.

3. A 3/3 way control valve as defined by claim 2, wherein, said pole legs (23) of the yoke (18) are uninsulated in their outer jacket face for dissipation of heat.

4. A 3/3 way control valve as defined by claim 2, in which, at least one of the pole legs (23) of the yoke (18) is welded in place at a middle section (22) of the yoke (18) that passes through the winding (19).

5. A 3/3 way control valve as defined by claim 2, which includes, a plastically deformable stop plate (27) for said restoring spring (13), which is plastically deformable in the spring force direction away from said slide valve member.

6. A 3/3 way control valve as defined by claim 1, wherein, said pole legs (23) of the yoke (18) are uninsulated in their outer jacket face for dissipation of heat.

7. A 3/3 way control valve as defined by claim 6, in which, at least one of the pole legs (23) of the yoke (18) is welded in place at a middle section (22) of the yoke (18) that passes through the winding (19).

8. A 3/3 way control valve as defined by claim 1, in which, said extrusion coating (21) includes an end section (32) remote from said armature, has a circular cross section with a radial sealing device (33, 34), and electrical connection cables (35) which extend exteriorly thereof through said radial sealing device.

9. A 3/3 way control valve as defined by claim 8, in which, said end section (32) includes an annular groove (33), and a toroidal sealing ring (34) in said annular groove for radial sealing.

10. A 3/3 way control valve as defined by claim 9, in which, said end section (32) includes a mounting bracket (35) which engages said extrusion coating (21).

11. A 3/3 way control valve as defined by claim 10, in which, said mounting bracket (35) axially limits said annular groove (33) for said toroidal sealing ring (34) on one side thereof.

12. A 3/3 way control valve as defined by claim 8, in which, said end section (32) includes a mounting bracket (35) which engages said extrusion coating (21).

13. A 3/3 way control valve as defined by claim 1, in which, at least one of the pole legs (23) of the yoke (18) is welded in place at a middle section (22) of the yoke (18) that passes through the winding (19).

14. A 3/3 way control valve as defined by claim 1, which includes, a plastically deformable stop plate (27) for said restoring spring (13), which is plastically deformable in the spring force direction away from said slide valve member.

15. A 3/3 way control valve as defined by claim 14, in which, said stop plate (27) is resiliently fastened in a peripheral region to compensate for a loss of plasticity with aging.

16. A 3/3 way control valve as defined by claim 15, in which, said control slide valve includes an axial bore, and said stop plate (27) is deformable by means of an adjusting pin with said control valve in its assembled state through said axial bore in said control slide (5).

17. A 3/3 way control valve as defined by claim 14, in which, said control slide valve includes an axial bore, and said stop plate (27) is deformable by means of an adjusting pin with said control valve in its assembled state through said axial bore in said control slide (5).

* * * * *